US008014555B2

(12) United States Patent
Hyde et al.

(10) Patent No.: US 8,014,555 B2
(45) Date of Patent: Sep. 6, 2011

(54) SELF-COOLING ELECTROMAGNETIC TRANSDUCER

(75) Inventors: Ralph E. Hyde, Santa Clarita, CA (US); Douglas J. Button, Simi Valley, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 1452 days.

(21) Appl. No.: 11/392,984

(22) Filed: Mar. 28, 2006

(65) Prior Publication Data

US 2007/0237351 A1 Oct. 11, 2007

(51) Int. Cl.
*H04R 1/02* (2006.01)

(52) U.S. Cl. ..... 381/397; 381/396; 381/412

(58) Field of Classification Search ..... 381/397, 381/401, 421, 396, 414
See application file for complete search history.

(56) References Cited

U.S. PATENT DOCUMENTS

| | | | | |
|---|---|---|---|---|
| 5,042,072 | A * | 8/1991 | Button | 381/397 |
| 5,357,586 | A * | 10/1994 | Nordschow et al. | 381/397 |
| 5,748,760 | A | 5/1998 | Button et al. | |
| 6,353,613 | B1 * | 3/2002 | Kubota et al. | 370/389 |
| 6,430,300 | B1 * | 8/2002 | Cox et al. | 381/397 |
| 6,678,387 | B2 * | 1/2004 | Kemmerer | 381/397 |
| 6,768,806 | B1 | 7/2004 | Button et al. | |
| 6,774,510 | B1 | 8/2004 | Moro et al. | |
| 6,847,726 | B2 | 1/2005 | Button et al. | |
| 6,868,165 | B1 * | 3/2005 | Fabian | 381/397 |
| 7,012,345 | B2 | 3/2006 | Moro et al. | |
| 7,039,213 | B2 * | 5/2006 | Hyre et al. | 381/414 |
| 7,066,654 | B2 * | 6/2006 | Wang et al. | 384/553 |
| 7,426,283 | B2 * | 9/2008 | Kaiya et al. | 381/397 |
| 7,574,013 | B2 * | 8/2009 | Funahashi et al. | 381/397 |
| 7,634,101 | B2 * | 12/2009 | Kemmerer | 381/397 |
| 7,831,059 | B1 * | 11/2010 | Sahyoun | 381/397 |
| 2001/0031063 | A1 * | 10/2001 | Langford et al. | 381/397 |

* cited by examiner

*Primary Examiner* — Curtis Kuntz
*Assistant Examiner* — Ryan Robinson
(74) *Attorney, Agent, or Firm* — The Eclipse Group LLP

(57) ABSTRACT

An electromagnetic transducer includes a housing, a diaphragm, a conductive coil, and a magnetic assembly having a plurality of air passages. The coil communicates with the diaphragm such that a flexible portion of the diaphragm is movable in response to movement of the coil. The coil includes axially spaced first and second coil portions. The magnetic assembly is disposed in the housing and is axially spaced from the diaphragm by an interior region. The coil portions are at least partially disposed in an annular gap formed in the magnetic assembly. Each air passage communicates with the interior region and with a respective aperture of the housing. The air passages provide respective air flow paths between the diaphragm and the ambient environment. Air flow through the passages is affected by movement of the flexible diaphragm portion for transferring heat from the transducer to the ambient environment.

25 Claims, 10 Drawing Sheets

SELF-COOLING ELECTROMAGNETIC TRANSDUCER

BACKGROUND OF THE INVENTION

1. Field of the Invention

This invention relates generally to electromagnetic transducers of the type that may be employed as electro-acoustical drivers for loudspeakers. More particularly, the invention relates to electromagnetic transducers and loudspeakers configured for removing heat via air flow.

2. Related Art

An electro-acoustical transducer may be utilized as a loudspeaker or as a component in a loudspeaker system to transform electrical signals into acoustical signals. The basic designs and components of various types of electro-acoustical transducers are well-known and therefore need not be described in detail. An electro-acoustical transducer typically includes mechanical, electromechanical, and magnetic elements to effect the conversion of an electrical input into an acoustical output. For example, the transducer typically includes a magnetic assembly, a voice coil, and a diaphragm. The magnetic assembly and voice coil cooperatively function as an electromagnetic transducer (also referred to as a driver or motor). The magnetic assembly typically includes a magnet (typically a permanent magnet) and associated ferromagnetic components—such as pole pieces, plates, rings, and the like—arranged with cylindrical or annular symmetry about a central axis. By this configuration, the magnetic assembly establishes a magnetic circuit in which most of the magnetic flux is directed into an annular (circular or ring-shaped) air gap (or "magnetic gap"), with the lines of magnetic flux having a significant radial component relative to the axis of symmetry. The voice coil typically is formed by an electrically conductive wire cylindrically wound for a number of turns around a coil former. The coil former and the attached voice coil are inserted into the air gap of the magnetic assembly such that the voice coil is exposed to the static (fixed-polarity) magnetic field established by the magnetic assembly. The voice coil may be connected to an audio amplifier or other source of electrical signals that are to be converted into sound waves. The diaphragm includes a flexible or compliant material that is responsive to a vibrational input. The diaphragm is suspended by one or more supporting elements of the loudspeaker (e.g., a surround, spider, or the like) such that the flexible portion of the diaphragm is permitted to move. The diaphragm is mechanically referenced to the voice coil, typically by being connected directly to the coil former on which the voice coil is supported.

In operation, electrical signals are transmitted as an alternating current (AC) through the voice coil in a direction substantially perpendicular to the direction of the lines of magnetic flux produced by the magnet. The alternating current produces a dynamic magnetic field, the polarity of which flips in accordance with the alternating waveform of the signals fed through the voice coil. Due to the Lorenz force acting on the coil material positioned in the permanent magnetic field, the alternating current corresponding to electrical signals conveying audio signals actuates the voice coil to reciprocate back and forth in the air gap and, correspondingly, move the diaphragm to which the coil (or coil former) is attached. Accordingly, the reciprocating voice coil actuates the diaphragm to likewise reciprocate and, consequently, produce acoustic signals that propagate as sound waves through a suitable fluid medium such as air. Pressure differences in the fluid medium associated with these waves are interpreted by a listener as sound. The sound waves may be characterized by their instantaneous spectrum and level, and are a function of the characteristics of the electrical signals supplied to the voice coil.

Because the material of the voice coil has an electrical resistance, some of the electrical energy flowing through the voice coil is converted to heat energy instead of sound energy. The heat emitted from the voice coil may be transferred to other operative components of the loudspeaker, such as the magnetic assembly and coil former. The generation of resistive heat is disadvantageous for several reasons. First, the conversion of electrical energy to heat energy constitutes a loss in the efficiency of the transducer in performing its intended purpose—that of converting the electrical energy to mechanical energy utilized to produce acoustic signals. Second, excessive heat may damage the components of the loudspeaker and/or degrade the adhesives often employed to attach various components together, and may even cause the loudspeaker to cease functioning. For instance, the materials of certain components themselves, as well as adhesives and electrical interconnects (e.g., contacts, soldered interfaces), may melt or become fouled or otherwise degraded. As additional examples, the voice coil may become detached from the coil former and consequently fall out of proper position relative to other components of the driver, which adversely affects the proper electromagnetic coupling between the voice coil and the magnet assembly and the mechanical coupling between the voice coil and the diaphragm. Also, excessive heat will cause certain magnets to become demagnetized; for example, neodymium (Nd) magnets will demagnetize above about 250° F. Thus, the generation of heat limits the power handling capacity and distortion-free sound volume of loudspeakers as well as their efficiency as electro-acoustical transducers. Such problems are exacerbated when one considers that electrical resistance through a voice coil increases with increasing temperature. That is, the hotter the wire of the voice coil becomes, the higher its electrical resistance becomes and the more heat it generates. As explained below, the problem with heat generation is exacerbated in dual-coil/dual magnetic gap designs.

Due to advantages such as lighter weight and higher power handling, dual-coil/dual magnetic gap designs have been supplanting single-coil designs in loudspeakers. Many dual-coil/dual-gap designs are able to produce more power output per transducer mass and dissipate more heat than conventional single-coil designs. In a dual-coil drive, the voice coil includes two separate windings axially spaced from each other to form two coils, although the same wire may be employed to form both coils. U.S. Pat. No. 5,748,760, commonly assigned to the assignee of the present disclosure, describes an example of a dual-coil design. In U.S. Pat. No. 5,748,760, the magnet assembly includes a stacked arrangement in which a magnet is axially interposed between a front pole piece and a rear pole piece. An outer ring is annularly disposed about the stacked arrangement such that an annular magnetic gap is defined between the outer ring and the stacked arrangement. The two coils are wound around a coil former and inserted into the gap such that one coil is located between the front pole piece and the outer ring and the other coil is located between the rear pole piece and the outer ring, in effect providing two magnetic gaps axially spaced from each other. As both coils provide forces for driving the diaphragm, the power output of the loudspeaker may be increased without significantly increasing size and mass. In addition, the magnet employed in the dual-coil drive is often a neodymium magnet. Neodymium is lighter in weight and provides more magnetic flux per mass (or weight) than more conventional magnetic materials such as ceramics, alnico, and the like. Accordingly, a neodymium magnet can be provided in a smaller size as compared with a more conventional magnet providing the same amount of magnetic flux. The utilization of a neodymium magnet also permits the utilization of smaller pole pieces.

The dual-coil configuration described in U.S. Pat. No. 5,748,760 provides more coil surface area as compared with many single-coil configurations, and thus ostensibly is capable of dissipating a greater amount of heat at a greater rate of heat transfer. For example, a dual coil design that doubles the surface area and number of turns of the coil winding may increase (e.g., nearly double) the capacity of the coil to dissipate heat. However, insofar as a desired advantage of the dual-coil driver is its ability to operate at a greater power output, so operating the dual-coil driver at the higher power output concomitantly causes the dual-coil driver to generate more heat. Hence, the improved heat dissipation inherent in the dual-coil design may be offset by the greater generation of heat. In U.S. Pat. No. 5,748,760, this problem is addressed by configuring the housing such that it contacts both the outer ring and the inner stacked arrangement of the magnetic assembly. As a result, a good amount of surface area is available for transferring heat from the magnetic assembly to the ambient environment via thermal conduction through the material of the housing. In addition, the housing includes cooling fins that further increase the surface area of the housing and consequently further enhance heat transfer. Moreover, the fins are positioned within the loudspeaker such that the fins are in thermal contact with air flowing through the housing as a result of the oscillating diaphragm.

Despite the foregoing approaches toward cooling dual-coil drivers, a need remains for further improvements. As compared to single-coil drivers, adequate heat dissipation in many dual-coil drivers, and more generally multiple-coil drivers, continues to be problem due to the longer thermal paths that must be traversed between the heat source (primarily the voice coil) and the ambient environment. For instance, in many desirable designs for multiple-coil drivers, one or more coils of the driver may be physically located at a significant distance from the ambient environment. Moreover, as noted above, neodymium magnet material or other thermally sensitive magnet material prone to demagnetization is utilized in many popular designs for multiple-coil drivers. In such designs, the neodymium magnet material is often positioned within (radially inside of) the voice coil, where the magnet material rapidly receives a large amount of heat energy due to its proximity to the voice coil and the large thermal gradient established between the magnet material and the voice coil. Accordingly, a need exists for providing improved means for rapidly removing significant amounts of heat from electrically conductive coil structures and magnetic structures during the operation of transducers and transducer-containing devices such as loudspeakers and the like.

SUMMARY

According to one implementation, an electromagnetic transducer includes a housing, a diaphragm, an electrically conductive coil, and a magnetic assembly having a plurality of air passages. The housing is disposed around a central axis and at least partially encloses an interior space. The housing has a plurality of apertures communicating with an ambient environment outside the housing. The diaphragm includes a flexible diaphragm portion reciprocatively movable relative to the central axis. The magnetic assembly is disposed in the housing and is axially spaced from the diaphragm by an interior region of the housing. The magnetic assembly has a gap annularly disposed about the central axis, and a plurality of air passages. Each air passage communicates with the medial interior region and with a respective one of the housing apertures. The coil mechanically communicates with the diaphragm, and includes a first coil portion and a second coil portion axially spaced from each other and at least partially disposed in the gap. The plurality of air passages provides a respective plurality of air flow paths between the diaphragm and the ambient environment, and in proximate thermal contact with the first and second coil portions. Air flow through the air passages is affected by movement of the flexible diaphragm portion for transferring heat from the transducer to the ambient environment.

According to another implementation, a method is provided for cooling an electromagnetic transducer. The transducer is provided with a magnetic assembly in which an annular gap is formed, a coil, and a diaphragm. The coil includes a first coil portion and a second coil portion axially spaced from each other. The first and second coil portions are at least partially disposed in the annular gap for magnetic coupling with the magnetic assembly. The diaphragm is axially spaced from the magnetic assembly and mechanically communicates with the coil. The magnetic assembly is disposed in a housing and has a plurality of air passages communicating on one side with an interior region of the housing between the diaphragm and the magnetic assembly and on another side with a plurality of respective apertures formed through the housing. An electrical signal is passed through the coil to cause the coil to oscillate and, in response, at least a portion of the diaphragm to oscillate, whereby the oscillation of the diaphragm portion produces sound. In addition, the oscillation of the diaphragm portion forces air to flow through the air passages and the housing openings and to an ambient environment outside of the housing, whereby the flowing air carries heat away from the coil and the magnetic assembly.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood by referring to the following figures. The components in the figures are not necessarily to scale, emphasis instead being placed upon illustrating the principles of the invention. In the figures, like reference numerals designate corresponding parts throughout the different views.

FIG. 8 is a perspective, exploded view illustrating various components of the loudspeaker illustrated in FIG. 1, according to the example of the implementation illustrated in FIG. 4 prior to assembly and mounting to a structure such as a baffle plate, cabinet, or the like.

DETAILED DESCRIPTION

FIGS. 1-11 describe various implementations of the present subject matter. For purposes of this application, in general, the term "communicate" (for example, a first component "communicates with" or "is in communication with" a second component) is used in the present disclosure to indicate a structural, functional, mechanical, electrical, optical, magnetic, ionic or fluidic relationship between two or more components (or elements, features, or the like). As such, the fact that one component is said to communicate with a second component is not intended to exclude the possibility that additional components may be present between, and/or operatively associated or engaged with, the first and second components.

Figure 1:
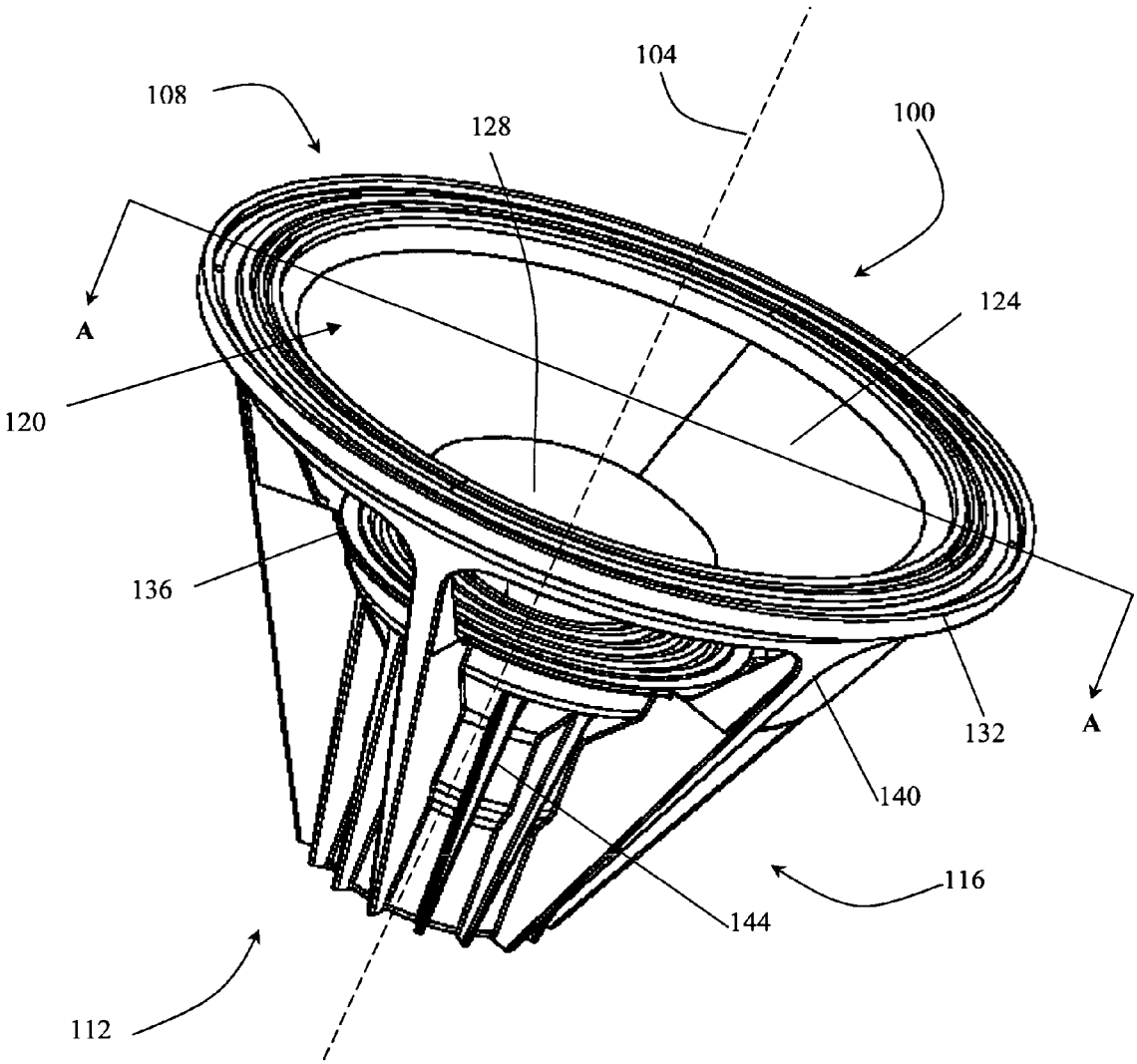
FIG. 1 is a top perspective view of an example of a loudspeaker of the invention.

Turning now to FIG. 1, FIG. 1 is a perspective view of an example of an electro-acoustical transducer in which one or more implementations of the invention may be provided. By way of example, the electro-acoustical transducer may be provided as a loudspeaker 100 or as part of the loudspeaker 100, although in other examples the electro-acoustical transducer is not limited to loudspeaker-type implementations. For purposes of description, the loudspeaker 100 may be considered as being generally arranged or disposed about a central, longitudinal axis 104. It will be understood, however, that the loudspeaker 100 is not limited to being completely symmetrical relative to such central axis 104. Also for purposes of description, the loudspeaker 100 and its components and features generally have a front or upper side 108 and a rear or lower side 112. It will be understood, however, that the use in this disclosure of terms such as "front," "upper," "rear" and "lower" is not intended to limit the loudspeaker 100 or any of its components and features to any particular orientation in space.

The loudspeaker 100 may include a housing 116. The housing 116 may be composed of any suitably stiff, anti-vibrational material such as, for example, a metal (e.g., aluminum, etc.). The utilization of aluminum or other thermally conductive material also enables the housing 116 to serve as a heat sink for the internal heat-generating components of the loudspeaker 100. The outer periphery of the housing 116 is generally swept about the central axis, such that the housing 116 may be considered as circumscribing or surrounding an interior space in which various components of the loudspeaker 100 are disposed. A housing 116 of this type may be referred to as a basket. Insofar as the housing 116 may constitute a combination of structural members and openings between structural members, the housing 116 may be considered at least partially enclosing this interior space. The space external to the housing 116, and more generally external to the loudspeaker 100, will be referred to as the ambient environment. In other implementations, the housing 116 may be continuous so as to completely enclose the interior space in which the components of the loudspeaker 100 are disposed, but openings are considered useful for allowing air to flow to and from the confines of the housing 116 and thus assisting in cooling the loudspeaker 100.

The loudspeaker 100 may also include a diaphragm 120 that spans the open front end of the housing 116. The diaphragm 120 may be any device that may be attached to or suspended by the housing 116 or other portion of the loudspeaker 100 in a manner that secures the diaphragm 120 while permitting at least a portion of the diaphragm 120 to move axially—i.e., along the direction of the central axis 104—in a reciprocating or oscillating manner. In the present example, the diaphragm 120 includes a generally cone-shaped member 124 (cone) that serves as an axially movable member, and a generally dome-shaped member 128 (dome) that may serve as a dust cover as well as an axially movable member. In other implementations, the movable portion of the diaphragm 120 may have a configuration other than conical, such as a dome or an annular ring. The cone 124 and dome 128 may be constructed from any suitably stiff, well-damped material such as paper. The cone 124 and dome 128 may be provided as a unitary or single-piece construction, or may be attached, connected, or adhered to each other by any suitable means. The cone 124 is attached to the housing 116 through one or more suspension members such as a surround 132 and a spider 136, either or both of which may be annular. The surround 132 and spider 136 may be affixed to the housing 116 by any suitable means. The surround 132 and spider 136 may be any devices that provide a mechanical interconnection between the diaphragm 120 and the housing 116, and allow the diaphragm 120 to move axially relative to the housing 116 while supporting the position of the diaphragm 120 radially relative to the housing 116. For this purpose, the surround 132 and spider 136 may be constructed from flexible, fatigue-resistant materials such as, for example, urethane foam, butyl rubber, phenolic-impregnated cloth, etc. In the illustrated example, the surround 132 and spider 136 have corrugated or "half-roll" profiles to enhance their flexibility and compliance. The surround 132 and spider 136 may be considered with the cone 124 and dome 128 as being parts of the assembly of the diaphragm 120, or may be considered as being components distinct from the diaphragm 120.

In the example illustrated in FIG. 1, the housing 116 generally includes an upper frame portion 140 and a lower frame portion 144. The upper frame portion 140 surrounds the diaphragm 120. The lower frame portion 144 surrounds several internal components of the loudspeaker 100, including an electromagnetic transducer or driver described in detail below.

Figure 2:
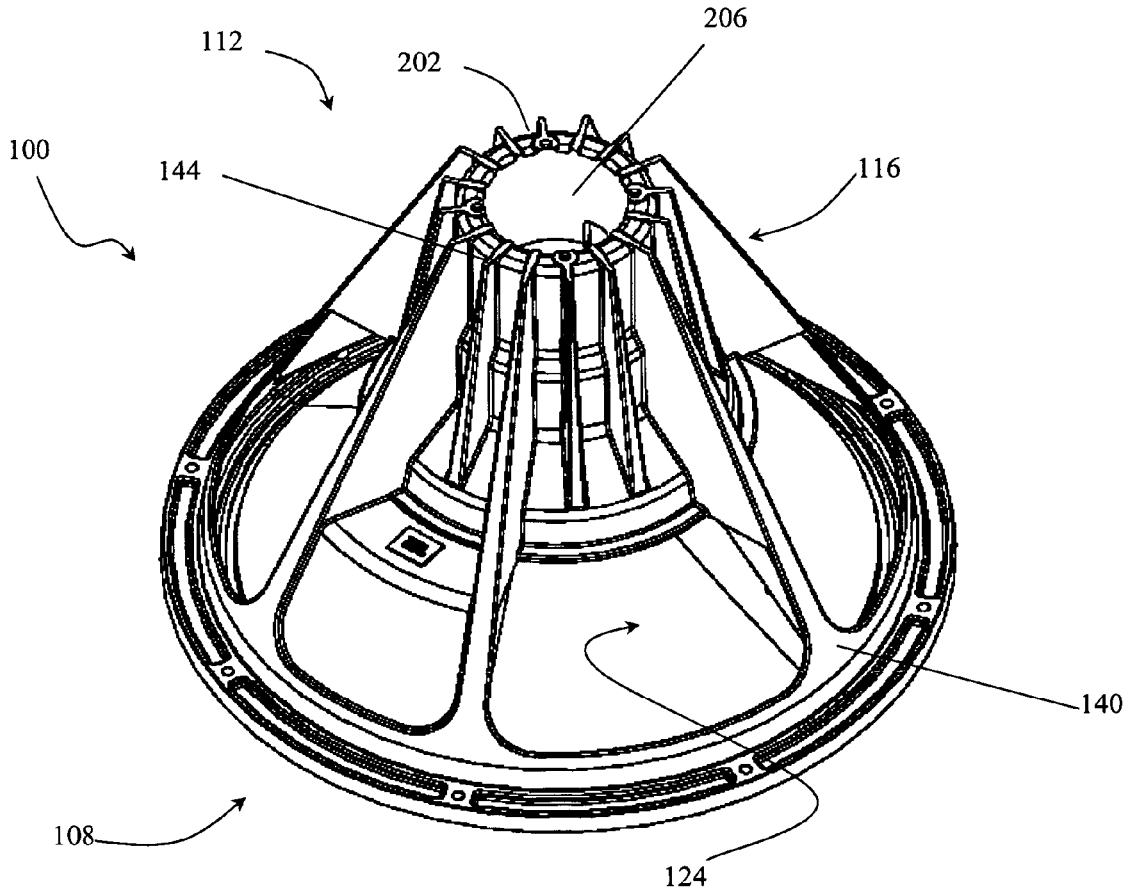
FIG. 2 is a bottom perspective view of the loudspeaker illustrated in FIG. 1.

FIG. 2 is rear perspective view of the loudspeaker 100 illustrated in FIG. 1. From this perspective, it can be seen that the lower frame portion 144 is bent or folded inwardly at a rear-most end 202 of the housing 116, and transitions to an inverted cup-shaped end frame portion or pedestal 206. The end frame portion 206 is described further below.

As a general matter, the loudspeaker 100 may be operated in any suitable listening environment such as, for example, the room of a home, a theater, or a large indoor or outdoor arena. Moreover, the loudspeaker 100 may be sized to process any desired range of the audio frequency band, such as the high-frequency range (generally 2 kHz-20 kHz) typically produced by tweeters, the midrange (generally 200 Hz-5 kHz) typically produced by midrange drivers, and the low-frequency range (generally 20 Hz-200 Hz) typically produced by woofers. In the examples provided in this description, the loudspeaker 100 may be considered as being of the direct-radiating type. However, in other alternative examples, the loudspeaker 100 may be considered as being of the compression driver type, the configuration of which is readily appreciated by persons skilled in the art.

Figure 3:
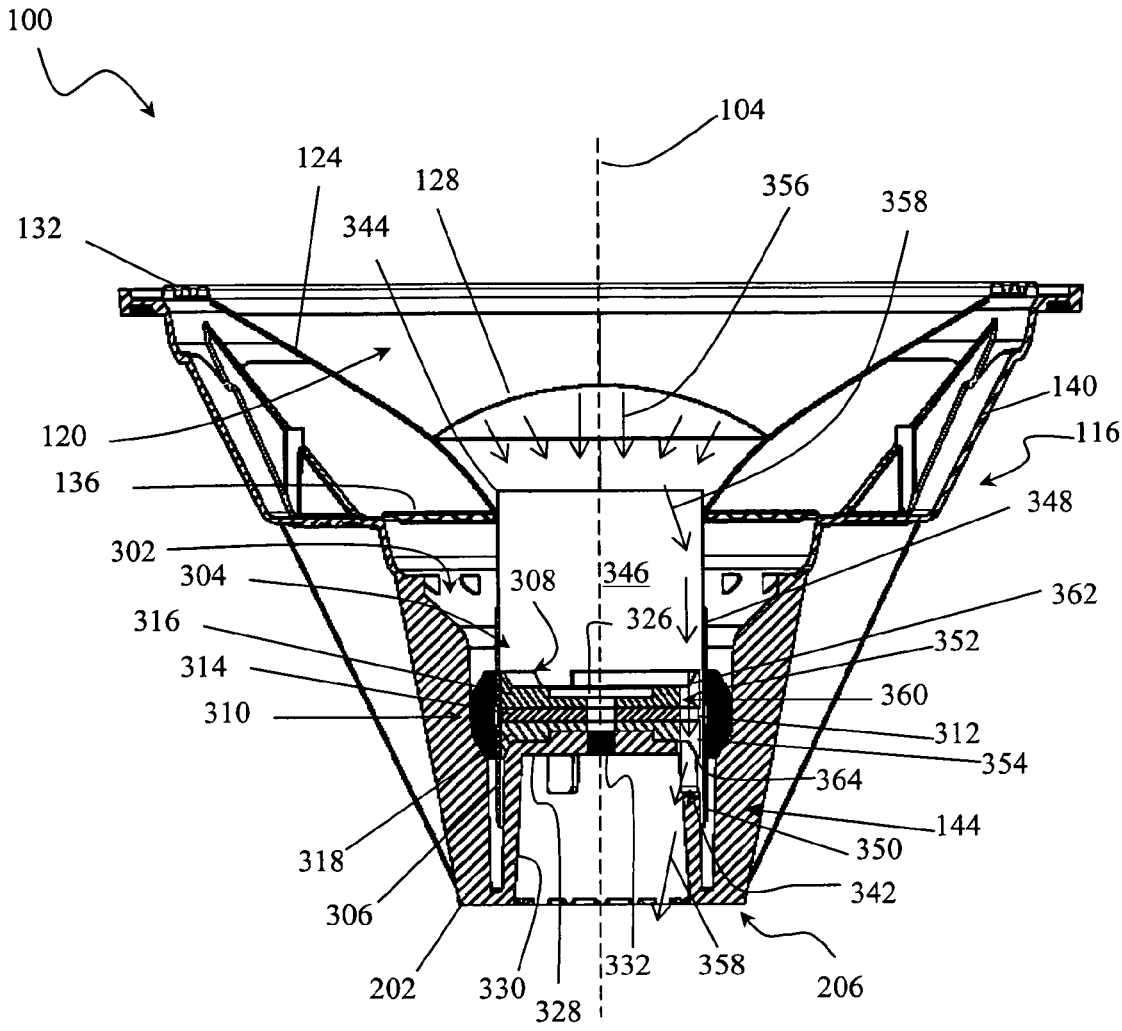
FIG. 3 is a cross-sectional view of the loudspeaker illustrated in FIGS. 1 and 2, taken along line A-A, according to one example of an implementation of the invention.

FIG. 3 is a cross-sectional view of the loudspeaker 100 illustrated in FIGS. 1 and 2 according to an example of one implementation of the invention. The cross-sectional view of FIG. 3 is taken along line A-A of FIG. 1. In this example, the loudspeaker 100 may be considered as having a "dual-coil drive" or "dual-coil motor" configuration or, more generally, a multiple-coil configuration. As illustrated in FIG. 3, an electromagnetic driver or motor 302 is generally disposed in the lower frame portion 144 of the housing 116. The driver 302 includes a magnetic assembly 304 and an electrically conductive coil 306 (e.g., voice coil). The magnetic assembly 304 may be any device suitable for providing a permanent magnetic field with which the coil 306 may be electro-dynamically coupled. In the illustrated example, the magnetic assembly 304 includes an inner magnetic portion 308 and an outer magnetic portion 310. Generally, the terms "inner" and "outer" in this context refer to the radial positions of the two magnetic portions 308 and 310 relative to the central axis 104 and to each other. The outer magnetic portion 310 is generally coaxially disposed about the central axis 104 and may be in the form of a ring or annulus. The outer magnetic portion 310 may be referred to as, or considered as including, a gap sleeve or outer ring. The outer magnetic portion 310 is radially spaced from the inner magnetic portion 308 such that the inner magnetic portion 308 and outer magnetic portion 310 cooperatively define an annular air gap 312 (or magnetic gap) between these two components. In operation, the gap 312 is immersed in the permanent magnetic field established by the magnetic assembly 304. The inner magnetic portion 308 may include a stacked arrangement of ferromagnetic components that may have any suitable configuration such as plates, disks, or the like. In the illustrated example, the inner magnetic portion 308 includes a magnetic element 314 (magnet) interposed between a first (upper or front) pole piece 316 and a second (lower or rear) pole piece 318. The magnet 314 may be composed of any permanent magnetic material such as, for example, a ceramic, alnico, or a magnetic rare earth metal, particularly neodymium (Nd). The pole pieces 316 and 318 may be composed of any material capable of carrying magnetic flux such as, for example, steel, cast iron, etc.

In some implementations, one or more outer surface sections of the inner magnetic portion 308, such as the outer surfaces of the pole pieces 316 and 318 and/or the inner surface of the outer magnetic portion 310, may be covered with a sheathing, coating, or plating (not shown) composed of an electrically conductive material such as, for example, copper (Cu), aluminum (Al), or the like. Such sheathing may be employed to reduce distortion and inductance in the loudspeaker 100. In one example, the sheathing has a thickness ranging from about 0.015 to 0.150 inch. In other implementations, electrically conductive shorting rings (not shown) may be employed instead of sheathing to reduce distortion and inductance. The shorting rings may be positioned at the front of the first pole piece 316, around the outer surface of the magnet 314, and/or at the rear of the second pole piece 318. The shorting rings may be composed of any suitable material (e.g., copper, aluminum, or the like), and may have thicknesses ranging from about 0.015 to 0.150 inch.

The magnetic assembly 304 may be secured within the housing 116 by any suitable means. In the example illustrated in FIG. 3, the outer magnetic portion 310 abuts an inside surface of the lower frame portion 144. The lower or rear side of the inner magnetic portion 308 abuts another inside surface of the lower frame portion 144 and the upper or front side of the inner magnetic portion 308 abuts a centrally located support member 326. More specifically in this example, the end frame portion or pedestal 206 of the housing 116 includes a base section 328 and a sidewall section 330 interconnecting the base section 328 at the rear-most end 202. The base section 328 provides the inside surface to which the inner magnetic portion 308 abuts. This configuration provides large areas of surface contact between the outer magnetic portion 310 and the housing 116, and between the inner magnetic portion 308 and the housing 116, thus providing enhanced heat transfer from the magnetic assembly 304 to the housing 116. Moreover, the dimensions of the lower frame portion 144 and end frame portion 206 relative to the coil 306 and magnetic assembly 304, and the contiguous relation between the lower frame portion 144 and the end frame portion 206, result in a large, continuous solid mass that serves well as a heat sink yet is relatively compact in design.

As also illustrated in the example of FIG. 3, the base section 328 has a central bore 332 that is aligned with respective central bores of the components of inner magnetic portion 308. By this configuration, the position of the inner magnetic portion 308 may be fixed by inserting the centrally located support member 326 through the respective central bores of the inner magnetic portion 308 and into the central bore 332 of the base section 328. The centrally located support member 326 may include threads that mate with threads within the central bore 332 of the base section 328, or the centrally located support member 326 may be coupled or attached to the base section 328 by any other suitable means. The base section 328 and/or the sidewall section 330 of the end frame portion 206 may have one or more apertures 342 formed through the thickness of the end frame portion 206, for a purpose described below.

The coil 306, which may be referred to as a voice coil, may generally be any component that oscillates in response to electrical current while being subjected to the magnetic field established by the magnetic assembly 304. In the illustrated example, the coil 306 is constructed from an elongated conductive element such as a wire that is wound about the central axis 104 in a generally cylindrical or helical manner. The coil 306 is mechanically referenced to, or communicates with, the diaphragm 120 by any suitable means that enables the oscillating coil 306 to consequently actuate or drive the diaphragm 120 in an oscillating manner, thus producing mechanical sound energy correlating to the electrical signals transmitted through the coil 306. In the illustrated example, the coil 306 mechanically communicates with the diaphragm 120 through a coil support structure or member such as a coil former 344. The coil former 344 may be cylindrical as illustrated by example in FIG. 3, and may be composed of a stiff, thermally resistant material such as, for example, a suitable plastic (e.g., polyamide, etc.). The coil former 344 also functions to support the coil 306. The diameter of the coil former 344 is greater than the outside diameter of the inner magnetic portion 308 and less than the inside diameter of the outer magnetic portion 310, enabling the coil former 344 in practice to extend into, and be free to move axially through, the gap 312 between the inner magnetic portion 308 and outer magnetic portion 310. At least a portion of the coil 306 is wound or wrapped on the outer surface of coil former 344 and may be securely attached to the coil former 344 such as by an adhesive. The coil 306 may be positioned on the coil former 344 such that at any given time during operation of the loudspeaker 100, at least a portion of the coil 306 is disposed in the gap 312. With this configuration, in operation the coil former 344 oscillates with the coil 306 and the oscillations are translated to the diaphragm 120.

The magnetic assembly 304 is axially spaced from the diaphragm 120. The portion of the interior space of the loudspeaker 100 that generally separates the magnetic assembly 304 from the diaphragm 120 along the axial direction will be referred to as a medial interior region 346. In the present example in which the coil former 344 is connected to the diaphragm 120 in the manner illustrated in FIG. 3, the coil 306 is likewise separated from the diaphragm 120 by the medial interior region 346.

As previously noted, the loudspeaker 100 may be considered as having "dual-coil drive" or "dual-coil motor" configuration. This configuration may be realized in the example illustrated in FIG. 3 forming the coil 306 so as to include a plurality of distinct coil portions, such that the coil 306 in effect constitutes a plurality of individual coils. In the present example, the wire of the coil 306 is wound around the coil former 344 for a desired number of turns to form a first (upper or front) coil portion 348, then runs down the side of the coil former 344 for an axial distance, and then is wound around the coil former 344 for a desired number of turns to form a second (lower or rear) coil portion 350 that is axially spaced from the first coil portion 348. The portion of the wire extending between the first coil portion 348 and the second coil portion 350 may be insulated to electrically isolate this portion of the wire from the two coil portions 348 and 350. The two ends of the wire may be connected to any suitable circuitry (including, for example, an amplifier) for driving the loudspeaker 100. The first coil portion 348 and the second coil portion 350 may be positioned on the coil former 344 such that at any given time during operation of the loudspeaker 100, at least a portion of the first coil portion 348 and at least a portion of the second coil portion 350 are disposed in the gap 312. Moreover, the first coil portion 348 may be positioned such that it is generally aligned with (i.e., adjacent to) the first pole piece 316, and the second coil portion 350 may be positioned such that it is generally aligned with (i.e., adjacent to) the second pole piece 318. By this configuration, the gap 312 may be considered as including a first (upper or front) gap 352 (or gap section) in which the first coil portion 348 extends between the first pole piece 316 and the outer magnetic portion 310, and a second (lower or rear) gap 354 (or gap section) in which the second coil portion 350 extends between the second pole piece 318 and the outer magnetic portion 310.

In a case where the first coil portion 348 has the same number of turns (windings) as the second coil portion 350, the number of turns is doubled in comparison to a single-coil configuration having the same number of turns of either individual coil portion 348 or 350. In addition, the surface area covered by the coil 306 having two coil portions 348 and 350 is also doubled. The wire forming the coil 306 may be run in a clockwise direction in one of the coil portions 348 or 350 and in a counterclockwise direction in the other coil portion 350 or 348. By this configuration, the electrical current runs through one of the coil portions 348 or 350 in a direction opposite to the electrical current running through the other coil portion 350 or 348. Because the magnetic flux lines established by the magnetic assembly 304 run in opposite directions in each of the first gap 352 and second gap 354 and the current in each coil portion 348 and 350 runs in opposite directions, Lorenz law holds that the force created by the current in each coil portion 348 and 350 runs in the same direction, thus doubling the force imparted to the coil former 344 and enabling the loudspeaker 100 to generate more power in comparison to a single-coil loudspeaker.

Generally, in operation the loudspeaker 100 receives an input of electrical signals at an appropriate connection to the coil 306, and converts the electrical signals into acoustic signals according to mechanisms briefly summarized above in this disclosure and readily appreciated by persons skilled in the art. The acoustic signals propagate or radiate from the vibrating diaphragm 120 to the ambient environment. In addition, the vibrating diaphragm 120 establishes air flow in the interior space of the loudspeaker 100, including in the medial interior region 346 between the diaphragm 120 and the magnetic assembly 304 and coil 306. As illustrated in FIG. 3, the downward axial movement of the diaphragm 120 pushes air generally axially in a downward direction through the medial interior region 346 and toward the magnetic assembly 304 and coil 306, as indicated by arrows 356.

The implementation illustrated in FIG. 3 utilizes this diaphragm-induced air flow as a heat transfer medium by which to rapidly carry large amounts of heat away from the magnetic assembly 304 and the coil 306. The illustrated implementation accomplishes this by providing a heat transfer fluid circuit for circulating a heat transfer fluid (i.e., air) generally between the diaphragm 120 and the ambient environment. More particularly, one or more heat-transferring air paths, generally indicated by arrows 358, are defined through the loudspeaker 100. Each air path is generally axially oriented, meaning that each air path predominantly runs through the loudspeaker 100 in a direction generally parallel with the central axis 104 although may include one or more radial components along its course. Each air path is defined in part by an air passage, vent or channel 360 of generally axial orientation formed through the loudspeaker 100 in close enough proximity to the coil 306 and magnetic assembly 304 to be in good thermal contact with, and consequently carry heat away from, the coil 306 and magnetic assembly 304.

In some implementations, the air passages 360 may be formed through the housing 116, such as through the lower frame portion 144, or through the outer magnetic portion 310. In other implementations, as illustrated in FIG. 3, the air passages 360 may be formed through the inner magnetic portion 308. In still other implementations, different air passages 360 may be formed through two or more of the foregoing different structures. Moreover, an individual air passage 360 may pass through two or more of the foregoing different structures, and two or more such air passages 360 may be provided.

In the example illustrated in FIG. 3, each air passage 360 is formed through the stacked arrangement of components constituting the inner magnetic portion 308. More specifically, in axial order, each air passage 360 is formed through the first pole piece 316, the magnet 314, and the second pole piece 318. Each air passage 360 has a first opening 362 corresponding to the opening in the first pole piece 316 that faces the medial interior region 346 of the loudspeaker 100 and underside of the diaphragm 120, and a second opening 364 corresponding to the opening in the second pole piece 318 that faces the housing 116 and the ambient environment. To provide open communication with the ambient environment, each air passage 360 fluidly communicates with a corresponding one of the above-noted apertures 342 of the housing 116—specifically, one of the apertures 342 formed through the thickness of the end frame portion 206 (see FIG. 9 below). As the opening in the second pole piece 318 directly registers with the aperture 342 of the housing 116, the second opening 364 of each air passage 360 may be considered as corresponding to the aperture 342 of the housing 116 (see FIG. 9 below).

In some implementations, the air passages 360 are formed as bores with completely closed inside surfaces running through the axial extent of the inner magnetic portion 308. That is, air passages 360 of this type are located radially inwardly of the outermost radial periphery of the inner magnetic portion 308 relative to the central axis 104, and solid material of the inner magnetic portion 308 exists between the air passages 360 and the annular gap 312. In other implementations, such as illustrated in FIG. 3, the air passages 360 are formed as recesses or cavities cut into the bodies of the inner magnetic portion 308 from the outermost radial periphery, such that the air passages 360 are in open communication with the annular gap 312. The air passages 360 formed as shown in FIG. 2 do not adversely affect the coupling between the magnetic assembly 304 and the coil 306.

By the configuration illustrated in FIG. 3, each air path begins in the medial interior region 346 adjacent to the underside (interior side) of the diaphragm 120, as represented by any one of the arrows 356. From the diaphragm 120, each air path runs through the medial interior region 346 toward the air passages 360. In the illustrated example, the coil former 344 and the diaphragm 120 are arranged such that the air paths run through the portion of the interior of the coil former 344 that is located within the medial interior region 346. From the medial interior region 346, the air path enters the first opening 362 of the air passage 360. In implementations where more than one air passage 360 is provided, each air path enters a corresponding one of the first openings 362 of the air passages 360. The air path then runs generally axially through the air passage 360, through the corresponding second opening 364 of the air passage 360 and aperture 342 of the housing 116, and exits into the ambient environment that serves in effect as an infinite heat sink.

As illustrated in FIG. 3, the air passages 360 are located such that the air flowing through the air passages 360 comes into direct contact, or at least into close thermal contact, with the various components of the inner magnetic portion 308, the outer magnetic portion 310, and the coil portions 348 and 350. The mass of air originating in the medial interior region 346 and pushed by the downward moving diaphragm 120 is initially at a lower temperature than these heated components of the driver 302. Accordingly, the air flowing through the air passages 360 is able to carry heat away from these components due to the existence of several thermal gradients. Although not specifically depicted in FIG. 3, it can be seen that during the times when the diaphragm 120 is moving or flexing axially forwardly in its vibratory cycle, the diaphragm 120 draws or pulls cool air from the ambient environment along reverse air paths, thus further cooling the internal components of the loudspeaker 100. The intake of external air into the loudspeaker 100 may be envisioned by reversing the direction of the arrows 356 and 358 shown in FIG. 3.

In the example illustrated in FIG. 3, the dome 128 of the diaphragm 120 is primarily responsible for circulating air through the loudspeaker 100. It can be appreciated, however, that other flexible, reciprocating components of the diaphragm 120 of sufficient surface area, such as the cone 124 and/or the spider 136, may alternatively or additionally contribute to the air circulation.

While the specific example illustrated in FIG. 3 provides two coil portions 348 and 350 and two corresponding gaps 352 and 354, it will be understood that other implementations may provide more than two coil portions 348 and 350 and gaps 352 and 354.

Figure 4:
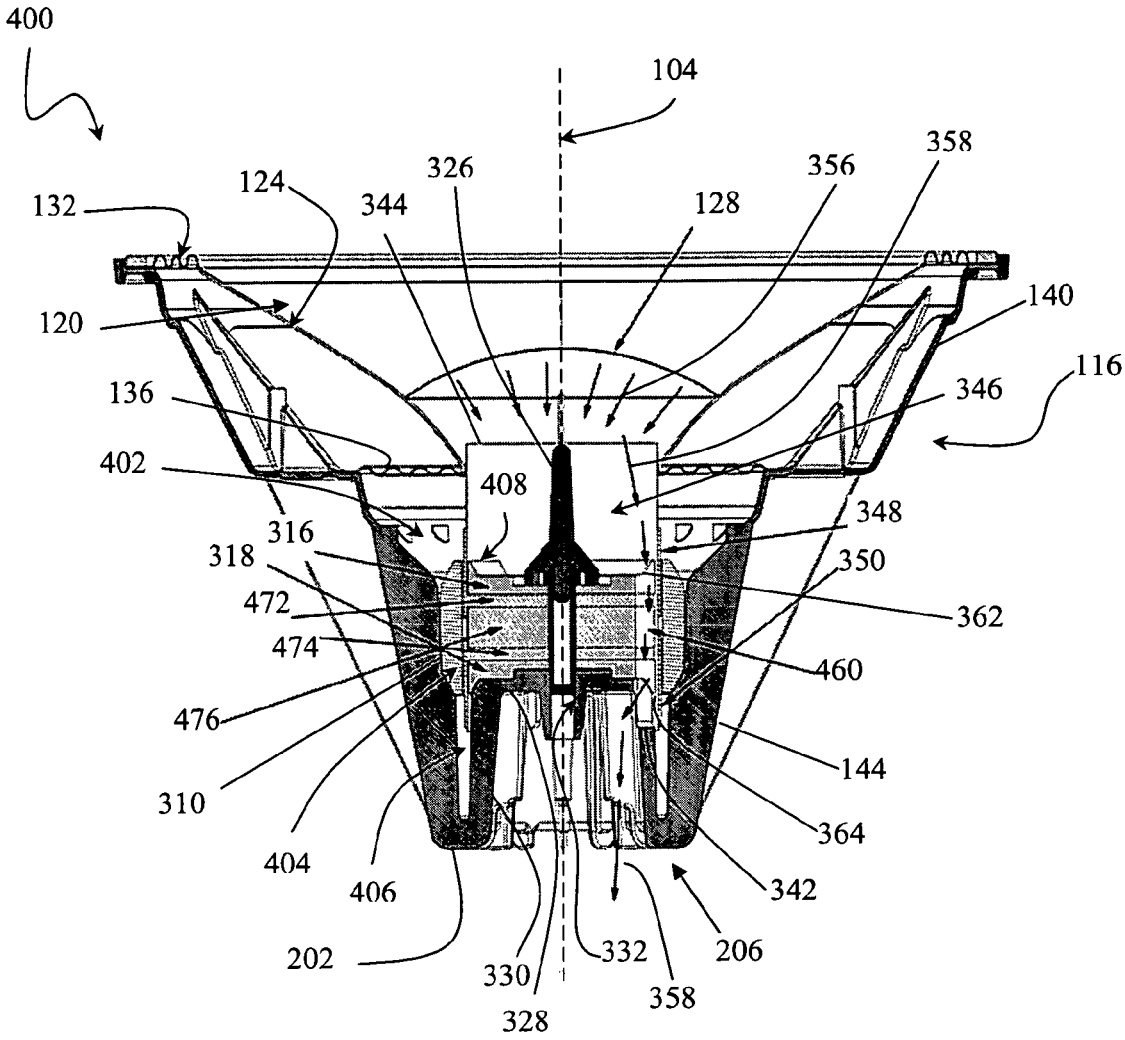
FIG. 4 is a cross-sectional view of the loudspeaker illustrated in FIGS. 1 and 2, taken along line A-A, according to another example of an implementation of the invention.

FIG. 4 is a cross-sectional view of an example of another implementation of a loudspeaker 400 of dual-coil/dual-gap design to which the self-effected air cooling technique may be applied. Many of the components and features provided in the implementation illustrated in FIG. 4 may be the same or similar to those illustrated in FIG. 3. Accordingly, as between FIGS. 3 and 4, like reference numerals designate like components and features.

The implementation illustrated in FIG. 4 provides an electromagnetic driver or motor 402, including a magnetic assembly 404 and a coil 406, that is particularly suited for handling sound production involving high-output power and/or deep-bass acoustics, which often require the coil 406 to undergo large axial excursions. In many voice coil motor designs of the prior art, and particularly dual-coil designs, the practical range of axial excursion is limited. This is because, when large excursions are demanded for high output or deep bass, the upper coil may move into the lower magnetic gap and the lower coil may move into the upper magnetic gap, which may result in extreme distortion and damage to components of the loudspeaker. This problem is particularly acute in drivers employing thin magnets such as neodymium magnets, because in these drivers the upper and lower gaps are positioned close together.

In the implementation illustrated in FIG. 4, this problem is addressed by providing a driver 402 in which the axial distance or spacing between the first and second coil portions 348 and 350, first and second pole pieces 316 and 318, and first and second magnetic gap sections 352 and 354 is increased. The increase in axial spacing is attained by splitting the magnet of the magnetic assembly 404 into two axially spaced-apart magnet portions, which will be referred to in this disclosure as a first (upper or front) magnet 472 and a second (lower or rear) magnet 474. Structurally, the first and second magnets 472 and 474 may be equal halves. In addition, a spacer member 476 is inserted between the two magnets 472 and 474 to spread the first and second magnets 472 and 474 farther apart axially. As shown in the example of FIG. 4, the axial dimension of the spacer member 476 may be greater than that of the pole pieces 316 and 318 and that of the magnets 472 and 474. The spacer member 476 may be composed of any suitable ferromagnetic material such as, for example, steel. The spacer member 476 may be composed of the same material as the pole pieces 316 and 318. The first magnet 472 is interposed between the first pole piece 316 and the spacer member 476, and the second magnet 474 is interposed between the second pole piece 318 and the spacer member 476. As a result, the overall axial dimension of the inner magnetic portion 408 may be greater than dual-coil drivers that lack the spacer member 476 and axially split magnets 472 and 474. Accordingly, the axial dimension of the outer magnetic portion 310 may be increased as needed to accommodate the axially longer driver 402.

Figure 5:
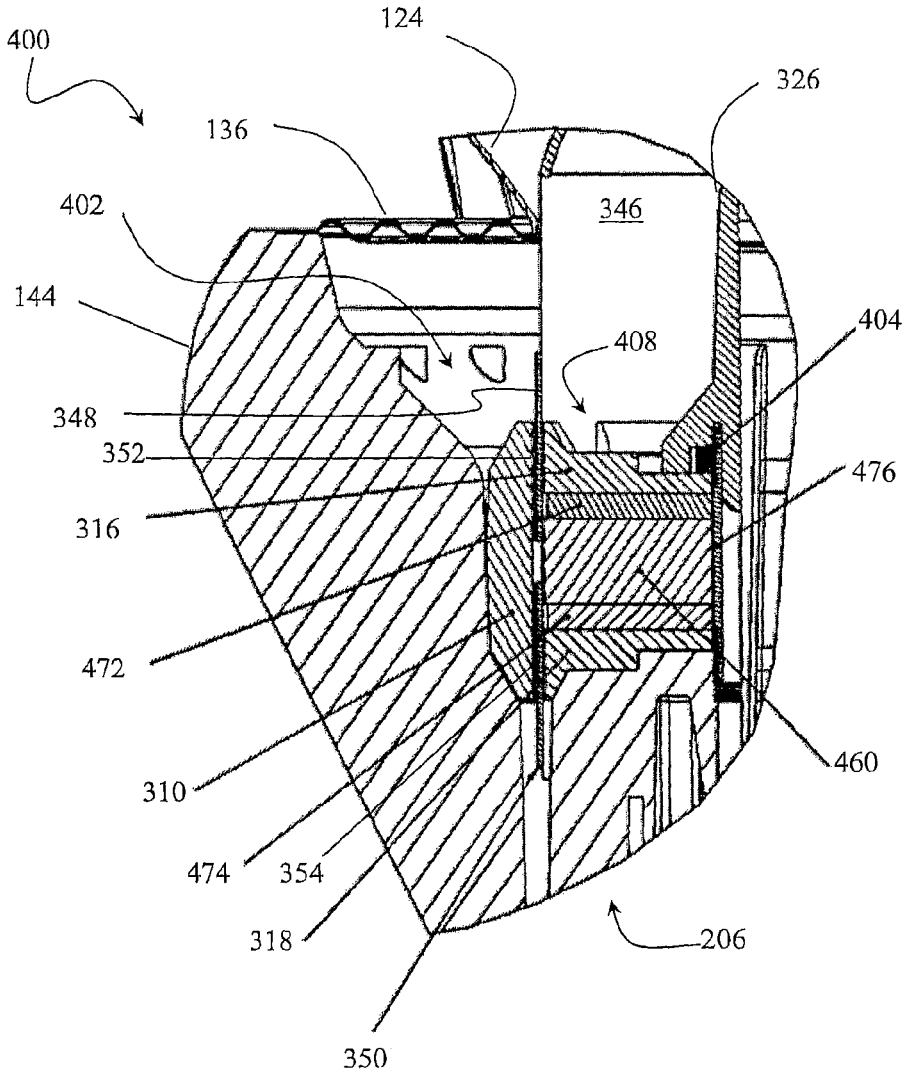
FIG. 5 is a cut away view of a portion of the loudspeaker illustrated in FIG. 4.

FIG. 5 is a cross-sectional view of a portion of the loudspeaker 400 illustrated in FIG. 4. In particular, FIG. 5 illustrates the features of the driver 402 in more detail. It can again be seen that the axial separation of the first and second pole pieces 316 and 318, first and second gaps 352 and 354, and first and second coil portions 348 and 350 increases the axial excursion capability of the driver 402. In the operation of the loudspeaker 400, the increased excursion capability may result in increased output, increased bass response, decreased distortion, and a lessening of the risk for damage due to excessive excursion.

At first glance it might appear that, due to the relatively large area between the outer diameter of the spacer member 476 and the outer magnetic portion 310 and the proximity of the spacer member 476 to the magnetic flux return path, a path is created that would result in shunting the flux or "shorting out" the magnetic circuit. However, very little flux is lost through this path because the respective ferromagnetic materials (e.g., steel) of both the spacer member 476 and the outer magnetic portion 310 are at the same magnetic potential, i.e., both are neutral or at ground potential.

The spacer member 476 illustrated by way of example in FIGS. 4 and 5 has a cylindrical geometry. In other implementations, the spacer member 476 may have other suitable geometries such as, for example, rings, necked-down cylinders, and the like. Moreover, the spacer member 476 may have a hollow or solid cross-section. Additionally, the spacer member 476 may include features such as, for example, recesses, cavities, bores, grooves, channels, and the like. Furthermore, the spacer member 476 may provide an advantageous location for the provision of shorting rings and/or flux modulation rings for controlling flux modulation and distortion, as well as phase-change heat absorbers.

While the specific example illustrated in FIGS. 4 and 5 provides two coil portions 348 and 350 and two corresponding gaps 352 and 354, it will be understood that other implementations may provide more than two coil portions 348 and 350 and gaps 352 and 354. It will also be understood that other implementations may provide more than one spacer member 476.

In addition to the foregoing aspects of the loudspeaker 400 illustrated in FIGS. 4 and 5, the increased axial spacing between the first and second coil portions 348 and 350 provided by the loudspeaker 400 may offer more opportunity for heat dissipation as compared with, for example, the implementation illustrated in FIG. 3. However, any such gain in heat-dissipating capacity may be offset to some degree by an increase in the generation of heat, due to operating the loudspeaker 400 of FIGS. 4 and 5 at the greater power output enabled by the increased excursion capacity. Moreover, the increased axial dimensions of the magnetic assembly 404 illustrated in FIGS. 4 and 5 may result in longer thermal paths between the heat-generating coil 406 and the ambient environment. Accordingly, the self-driven air circulation system described above in conjunction with FIG. 3 is particularly useful when applied to the implementation illustrated in FIGS. 4 and 5.

Referring back to FIG. 4, one or more generally axially oriented, heat-transferring air paths, generally indicated by arrows 358, are defined through the loudspeaker 400 in a manner similar to that described above in conjunction with FIG. 3. Each air path is defined in part by an air passage or channel 460 of generally axial orientation formed through the loudspeaker 400 in close enough proximity to the coil 406 and magnetic assembly 404 to be in good thermal contact with, and consequently carry heat away from, the coil 406 and magnetic assembly 404. In the example illustrated in FIG. 4, each air passage 460 is formed, in axial order, through the first pole piece 316, the first magnet 472, the spacer member 476, the second magnet 474, and the second pole piece 318. Each air passage 460 has a first opening 362 in communication with the medial interior region 346 of the loudspeaker 400, and a second opening 364 in communication with a corresponding aperture 342 of the housing 116.

By the configuration illustrated in FIG. 4, each air path begins in the medial interior region 346 adjacent to the underside of the diaphragm 120, as represented by any one of the arrows 356. From the diaphragm 120, each air path runs through the medial interior region 346 toward the air passages 460, and enters the first opening 362 of one of the air passages 460. The air path then runs generally axially through the air passage 460 adjacent to the hot components of the coil 406 and magnetic assembly 404, through the corresponding second opening 364 of the air passage 460 and aperture 342 of the housing 116, and exits into the ambient environment. As in the case of the implementation illustrated in FIG. 3, the oscillatory movements of the diaphragm 120 effect a cyclical pushing and pulling of air through the air passages 460 and other confines of the loudspeaker 400, thus cooling the internal components such as the coil 406 and magnetic assembly 404. It will again be appreciated that the loudspeaker 400 may be configured such that any reciprocating component of the diaphragm 120, such as the dome 128, the cone 124, and/or the spider 136, may contribute to the air circulation.

As previously noted in conjunction with the implementation illustrated in FIG. 3, in alternative implementations the air passages 460 may be formed through one or more portions of the housing 116 and/or through the outer magnetic portion 310. Moreover, in some implementations, the air passages 460 may be formed as bores located radially inwardly of the outermost radial periphery of the inner magnetic portion 408, while in other implementations the air passages 460 may be formed as recesses or cavities cut into the inner magnetic portion 408 such that the air passages 460 are in open communication with the annular gap 312.

Figure 6:
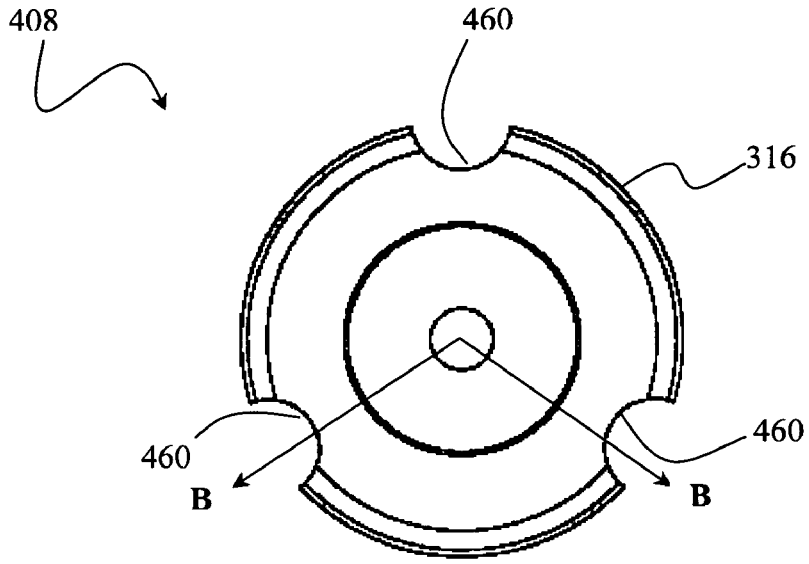
FIG. 6 is a top plan view of a stacked arrangement of components of a magnetic assembly according to an example of an implementation of the invention.

FIG. 6 is a top plan view of an example of the inner magnetic portion 408 of the implementation illustrated in FIGS. 4 and 5. In this example, the air passages 460 are formed as recesses or cavities cut from the outer periphery into the interiors of the stacked components of the inner magnetic portion 408. While in this example three air passages 460 are formed, other implementations may include less or more than three air passages 460. Although no specific limitations are placed on the dimensions of the air passages 460 (e.g., length, cross-sectional area), certain factors may be considered in the sizing of the air passages 460. For instance, air passages 460 that are too small in cross-section may result in excessive air noise. Also, air passages 460 that are too large in cross-section or length may not adequately exchange heat with the ambient environment. More generally, to ensure adequate air flow through the air passages 460 between the heat-generating components and the ambient environment, fluid mechanics-related considerations may be taken into account when designing the air passages 460 as readily appreciated by persons skilled in the art.

Figure 7:
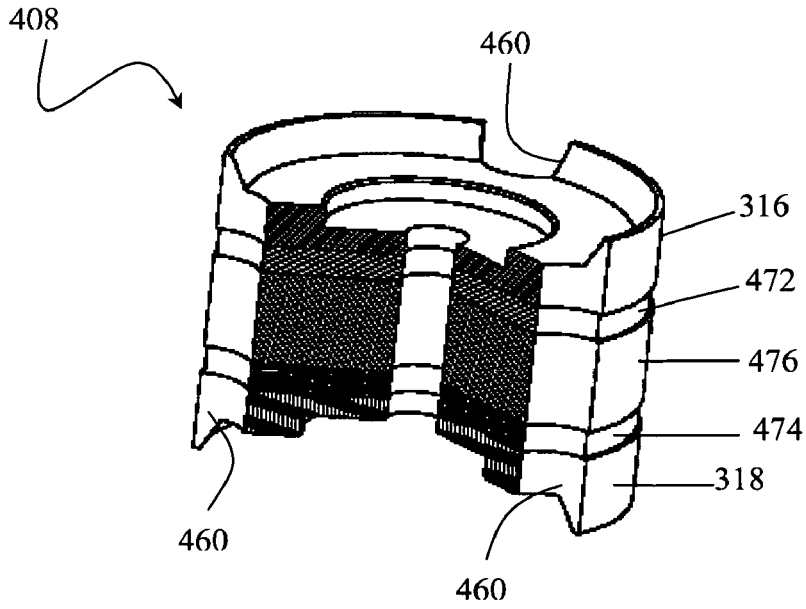
FIG. 7 is a perspective, cross-sectional view of the stacked arrangement illustrated in FIG. 6 taken along line B-B.

FIG. 7 is a perspective, partially cut-away view of the inner magnetic portion 408 illustrated in FIG. 6. As evident from FIG. 7, each air passage 460 may be formed through the axial extent of the inner magnetic portion 408 by fabricating corresponding sections of the air passage 460 in each of the stacked components. In assembly, the components are stacked together such that the fabricated sections are aligned to form the air passages 460.

Figure 8:
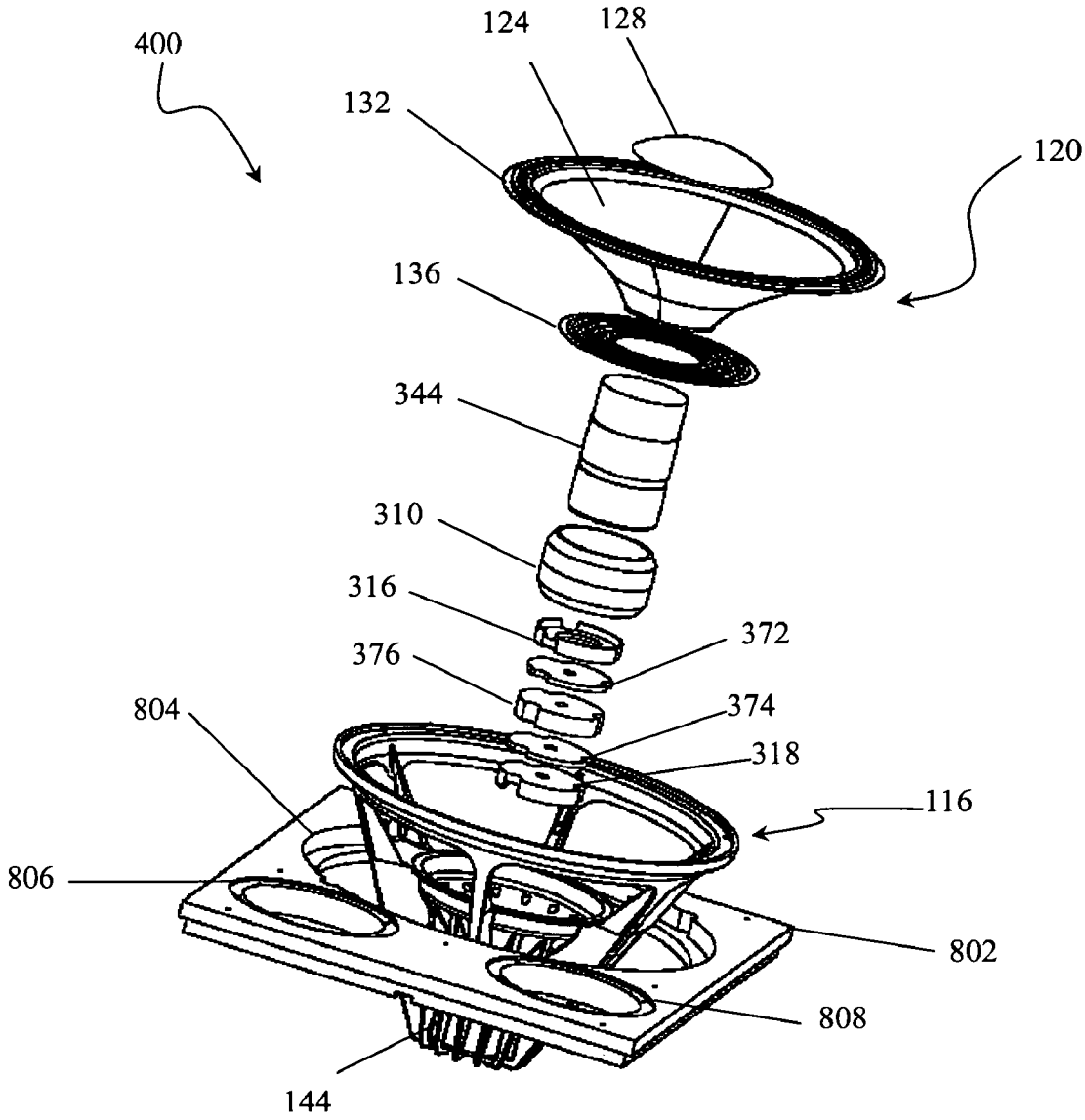

FIG. 8 is a perspective, exploded view illustrating various components of the loudspeaker 400 illustrated in FIGS. 4-7 prior to assembly. As shown in FIG. 8, the loudspeaker 400 may be mounted by any suitable means to a structure 802 such as a baffle plate, cabinet, wall, or the like. The structure 802 has an opening 804 sized to receive the loudspeaker 400. As appreciated by persons skilled in the art, the structure 802 may include additional openings 806 and 808 for mounting other loudspeakers, for outputting acoustic waves of the same frequency range as or different frequency ranges from the loudspeaker 400 described above.

Figure 9:
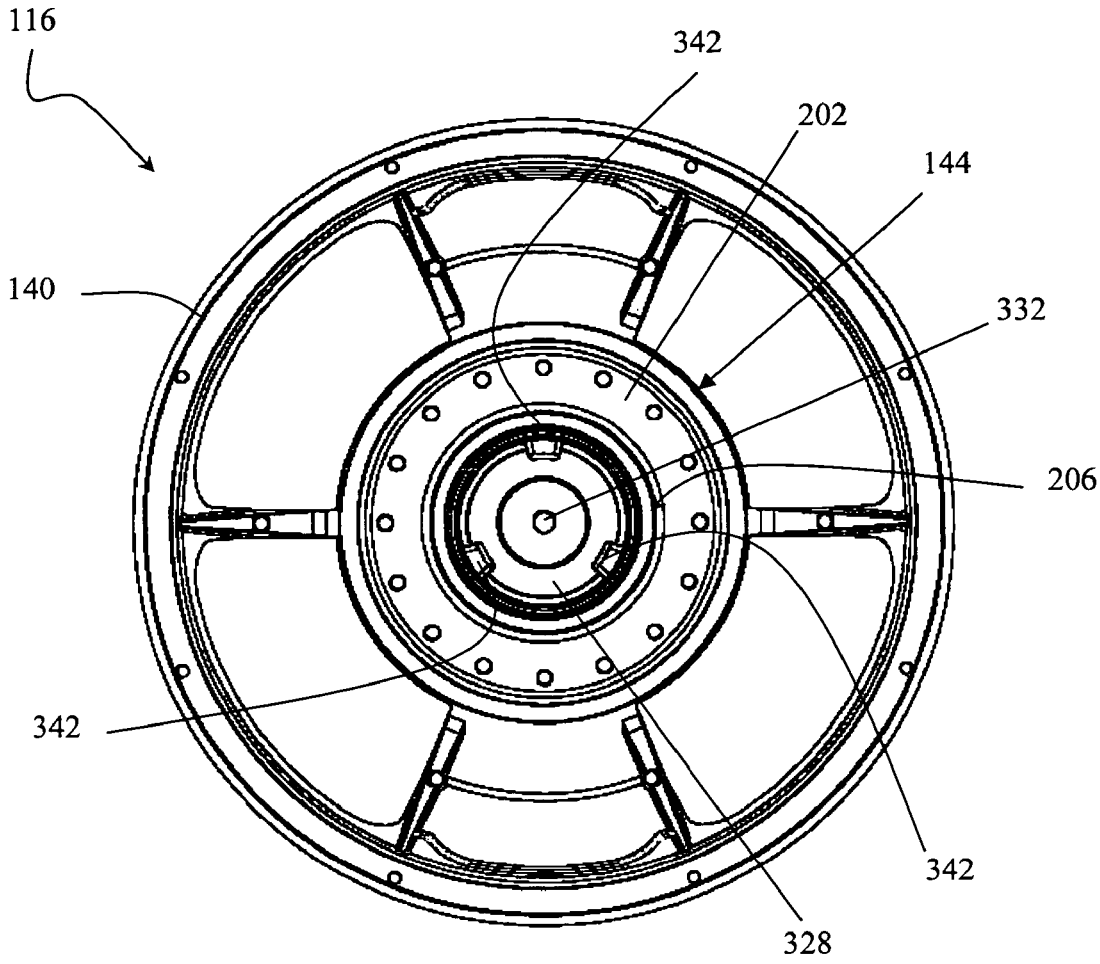
FIG. 9 is a top view of the frame portion of the loudspeaker illustrated in FIG. 8.

FIG. 9 is a top view of one example of one embodiment of the housing of the loudspeaker illustrated in FIG. 1. As illustrated in FIG. 9, the housing 116 includes a lower frame portion 144 and an upper frame portion 140. As also illustrated in FIGS. 3 & 4, the lower frame portion 144 includes an end portion or pedestal 206 having a base section 328 that supports the magnetic assembly 304. As best illustrated in FIGS. 3 & 4, the end frame portion or pedestal 206 of the housing 116 may take the form of an inverted cup-shaped portion of the lower frame 144, which functions to support the magnetic assembly 304 and bring the ambient air closer to the magnetic assembly 304. Moreover, the dimensions of the lower frame portion 144 and end frame portion 206 relative to magnetic assembly 304, and the contiguous relation between the lower frame portion 144 and the end frame portion 206, result in a large, continuous solid mass that serves well as a heat sink yet is relatively compact in design.

As also illustrated in the example of FIG. 9, the base section 328 has a central bore 332 that is aligned with respective central bores of the components of magnetic assembly 304. The base section 328 of the end frame portion 206 may also have one or more apertures 342 formed through the thickness of the end frame portion 206 for the purpose of aligning with air paths or air passages 360 (see FIGS. 3 &4) formed through the housing 116 of the loudspeaker 100 or through the stacked arrangement of components constituting the magnetic assembly 304. As described above, each air path is defined in part by an air passage, vent or channel 360 of generally axial orientation formed through the loudspeaker 100 in close enough proximity to the voice coil 306 and magnetic assembly 304 to be in good thermal contact with, and consequently carry heat away from, the coil 306 and magnetic assembly 304 outward through the apertures 342 in the lower frame 144.

Figure 10:
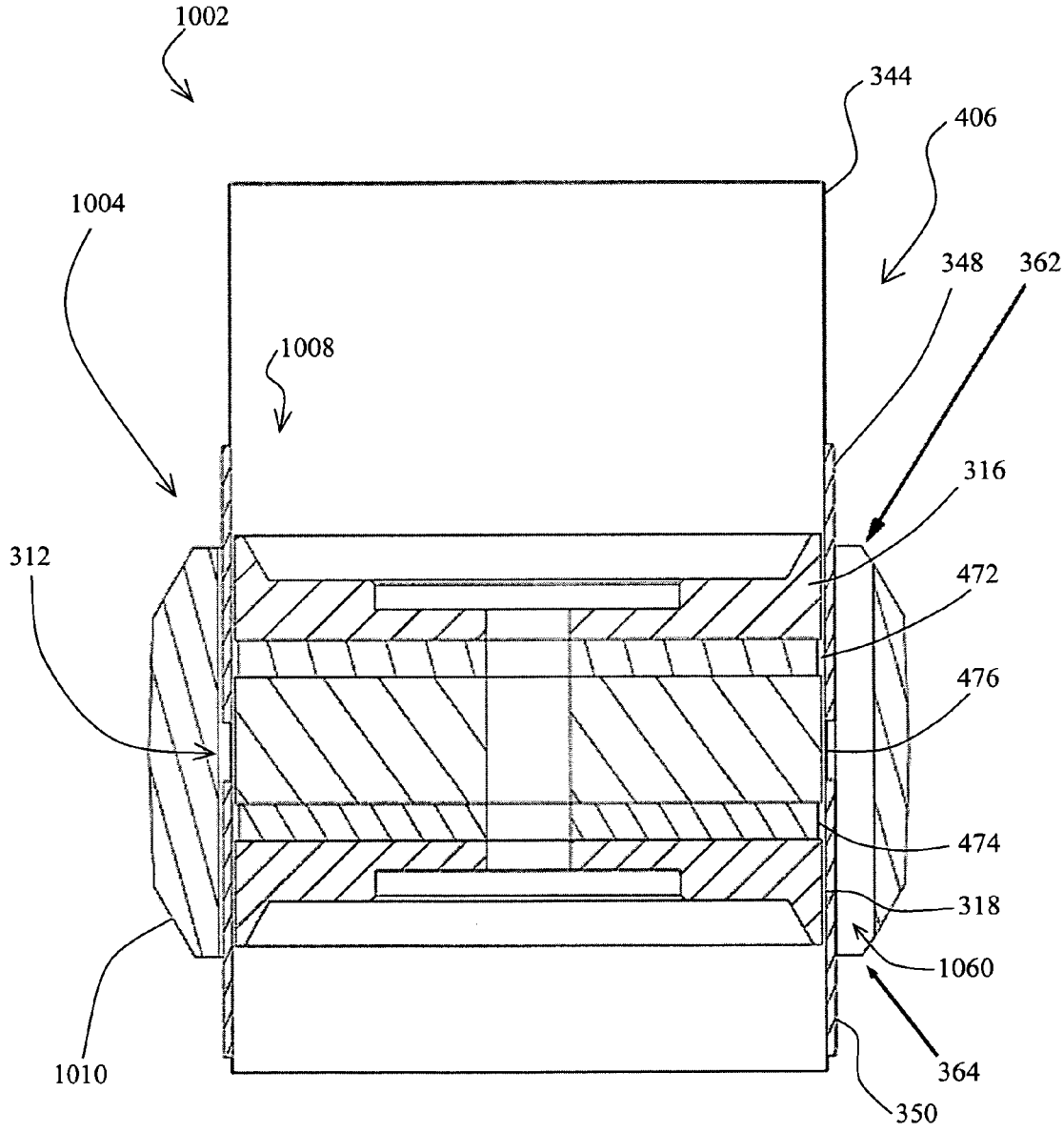
FIG. 10 is a cross-sectional view of an example of an electromagnetic driver or motor according to another implementation.

FIG. 10 is a cross-sectional view of an example of an electromagnetic driver or motor 1002 according to another example of an implementation. Many of the components and features provided in the implementation illustrated in FIG. 10 may be the same or similar to those illustrated in FIGS. 3-9. Accordingly, as between FIGS. 10 and 3-9, like reference numerals designate like components and features. In the implementation illustrated in FIG. 10, the driver 1002 includes an outer magnetic portion 1010 in which one or more air passages or channels 1060 are formed. The air passages 1060 may be formed through the entire axial extent of the outer magnetic portion 1010 as illustrated in FIG. 10, or may be formed through only a portion of the axial extent of the outer magnetic portion 1010. The resulting heat-transferring air paths may be similar to those generally indicated by arrows 356 and 358 in FIGS. 3 and 4. A primary difference in FIG. 10 is that because the air paths run through the outer magnetic portion 1010, this portion of the air paths runs along the outside (i.e., radially outwardly) of the coil 1006 yet still adjacent or proximate to the hot components of the coil 1006 and magnetic assembly 1004. The housing apertures 342 illustrated in FIGS. 3 and 4 may be modified or moved as needed for providing fluid communication between the air passages 1060 and the ambient environment. The air paths may otherwise be defined through the associated loudspeaker in a manner similar to that described above in conjunction with FIGS. 3 and 4. Accordingly, referring also to FIGS. 3 and 4, the first opening 362 of each air passage 1060 may communicate with the medial interior region 346 of a loudspeaker, and the second opening 364 may communicate with a corresponding aperture 342 of the housing 116. As in the case of other implementations described above, the loudspeaker associated with the driver 1002 may be configured such that any reciprocating component of a diaphragm, such as a dome, a cone, and/or a spider, may contribute to the movement of air through the air passages 1060.

The inner magnetic portion 1008 in the example illustrated in FIG. 10 does not include air passages. In other implementations, however, air passages such as the air passages 360 or 460 shown in FIG. 3 or 4 may be formed in the inner magnetic portion 1008 in addition to air passages 1060 formed in the outer magnetic portion 1010.

In the example illustrated in FIG. 10, the inner magnetic portion 1008 is the same as or similar to the inner magnetic portion 408 illustrated in FIGS. 4-8, and thus includes the first pole piece 316, the first magnet 472, the spacer member 476, the second magnet 474, and the second pole piece 318. In other implementations, however, the inner magnetic portion may be the same as or similar to the inner magnetic portion 1008 illustrated in FIG. 3, i.e., without the split magnet and spacer arrangement.

Figure 11:
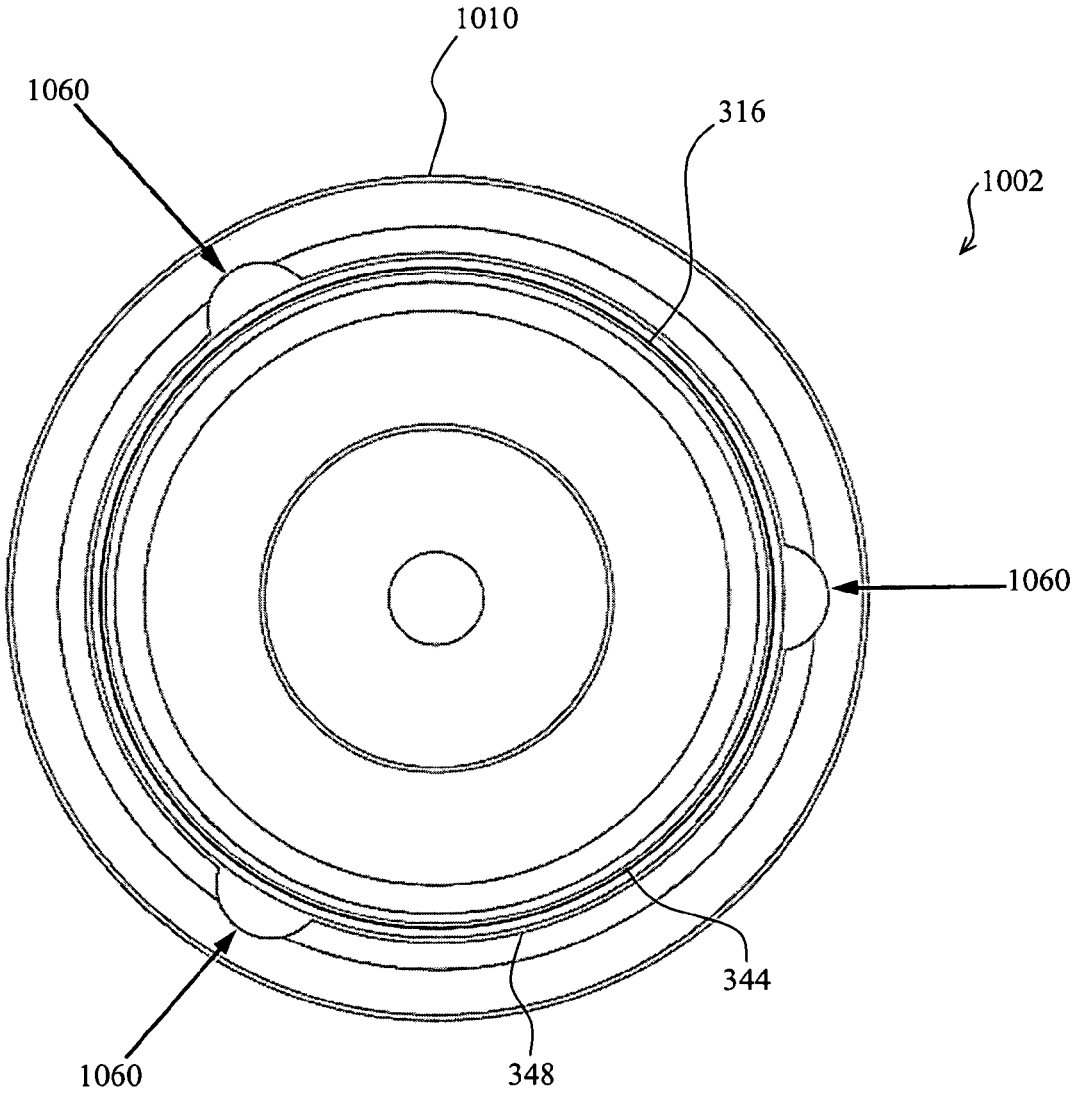
FIG. 11 is a top plan view of the driver assembly illustrated in FIG. 10.

FIG. 11 is a top plan view of the driver 1002 of the implementation illustrated in FIG. 10. In this example, the air passages 1060 are formed as recesses or cavities cut from the inner periphery of the outer magnetic portion 1010 and into its radial thickness. While in this example three air passages 1060 are formed, other implementations may include less or more than three air passages 1060.

It will be understood that the implementations illustrated in FIGS. 4-9 may likewise be generally representative of the implementation illustrated in FIG. 3, but without the inclusion of the spacer member 476 and split arrangement of magnets 472 and 474.

It can thus be seen that implementations provided in this disclosure may be useful in increasing the cooling of a conductive coil, magnet, and associated structures of an electromagnetic transducer such as the type utilized in or constituting a loudspeaker or other type of electro-acoustical transducer. The cooling is effected through the circulation of a heat transfer medium. The circulation is caused by operating the transducer in a normal manner, and the heat transfer medium is a fluid (e.g., air) normally existing in the transducer. No external or additional air moving means such as a fan or blower are required, although the subject matter of this disclosure encompasses implementations in which such air moving means may also be employed.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. An electromagnetic transducer comprising:

a diaphragm including a flexible diaphragm portion reciprocatively movable relative to a central axis;

a magnetic assembly axially spaced from the diaphragm, the magnetic assembly having a gap annularly disposed about the central, axis and a plurality of air passages;

a housing disposed around a central axis, the housing having an upper frame portion surrounding the diaphragm and a lower frame portion surrounding the magnetic assembly, the housing having an interior region forming an axial space between the diaphragm and the magnetic assembly, the lower frame portion formed to support the magnetic assembly and formed with a plurality of apertures aligned with the plurality of air passages in the magnetic assembly to provide a plurality of air flow paths from the interior region into the ambient environment outside the housing;

an electrically conductive coil mechanically communicating with the diaphragm, the coil having a plurality of coil portions including at least a first coil portion and a second coil portion axially spaced from each other and at least, partially disposed in the gap, whereby the plurality of air flow paths are in proximate thermal contact with the plurality of coil portions, the air, flow through the air passages is generated by movement of the flexible diaphragm portion in response to movement of the coil, and the air flow through the plurality of air flow paths transfers heat from the transducer to the ambient environment.

2. The transducer of claim 1, further including a coil support structure disposed in the gap, where the plurality of coil portions and the diaphragm are attached to coil support structure whereby the coil communicates with the diaphragm via the coil support structure.

3. The transducer of claim 2, where the coil support structure is annularly disposed about the central axis and extends into the interior region, and the air passages communicate with an interior of the coil support structure.

4. The transducer of claim 1, where the magnetic assembly includes a first pole piece, a second pole piece axially spaced from the first pole piece, and a magnet axially interposed between the first and second pole pieces.

5. The transducer of claim 4, where at least one of the air passages is formed in the first pole piece, the magnet, and the second pole piece.

6. The transducer of claim 1, where the magnetic assembly includes a first pole piece, a second pole piece axially spaced from the first pole piece, a first magnet axially interposed between the first and second pole pieces, a second magnet axially interposed between the first and second pole pieces and axially spaced from the first magnet, and a spacer axially interposed between the first and second magnets.

7. The transducer of claim 6, where at least one of the air passages is formed in the first pole piece, the first magnet, the spacer, the second magnet, and the second pole piece.

8. The transducer of claim 6, where the composition of the spacer includes a ferromagnetic material.

9. The transducer of claim 6, where the axial dimension of the spacer is greater than the axial dimensions of each of the first and second magnets.

10. The transducer of claim 6, where the composition of the first and second magnets includes a rare earth metal.

11. The transducer of claim 10, where the rare earth metal is neodymium.

12. The transducer of claim 1, where the magnetic assembly includes a plurality of magnets and at least one spacer, each spacer adjacent to at least one of the magnets.

13. The transducer of claim 1, where the coil includes one or more additional coil portions in addition to the first and second coil portions.

14. The transducer of claim 1, where at least one of the air passages is formed in the magnetic assembly on a side of the plurality of coil portions radially inward of the coil portions relative to the central axis.

15. The transducer of claim 1, where at least one of the air passages is formed in the magnetic assembly on a side of the plurality of coil portions radially outward of the coil portions relative to the central axis.

16. The transducer of claim 1, where the magnetic assembly includes an inner magnetic portion and an outer magnetic portion, the outer magnetic portion is coaxially disposed about the central axis and radially spaced from the inner magnetic portion whereby the gap is defined between the inner and outer magnetic portions, and at least one of the air passages is formed in the outer magnetic portion.

17. The transducer of claim 1, where at least one of the air passages is formed in the housing.

18. The transducer of claim 1, where the flexible diaphragm portion includes a dome.

19. The transducer of claim 1, where the flexible diaphragm portion includes a cone.

20. The transducer of claim 1, where the flexible diaphragm portion includes a suspension member.

21. The transducer of claim 1, where the flexible diaphragm portion is selected from the group consisting of a dome, a cone, a suspension member, and a combination of two or more of the foregoing.

22. A loudspeaker comprising a transducer as recited in claim 1.

23. A method for cooling an electromagnetic transducer comprising:

coupling an electrical signal to a coil on the electromagnetic transducer to cause the coil to oscillate causing at least a portion of a diaphragm connected to the coil to oscillate, the coil having a first coil portion and a second coil portion axially spaced from each other and at least partially disposed in an annular gap formed in a magnetic assembly contained within the coil to provide a magnetic coupling between the coil and the magnetic assembly;

generating an air flow through an interior region between the diaphragm and the magnetic assembly via the oscillation of the diaphragm;

passing the air flow through air passages formed in the magnetic assembly, the air passages being formed to pass the air flow in proximate thermal contact with the coil; and passing the air flow through apertures formed in a lower frame portion of a housing configured to surround and support the magnetic assembly, the housing having an upper frame portion configured to surround and support the diaphragm, the air flow passing through the apertures into the ambient environment to cool the magnetic assembly and the coil by carrying away heat away from the coil and magnetic assembly.

24. The method of claim 23, where the magnetic assembly includes an axial arrangement including a first pole piece, a second, pole piece, a first magnet, a second magnet, and a spacer, and at least one of the air passages is formed in the first pole piece, the first magnet, the spacer, the second magnet, and the second pole piece.

25. The method of claim 23, where the magnetic assembly includes an axial arrangement including a first pole piece, a second pole piece, and a magnet, and at least one of the air passages is formed in the first pole piece, the magnet, and the second pole piece.

* * * * *